United States Patent [19]

Reist et al.

[11] Patent Number: 4,512,457

[45] Date of Patent: Apr. 23, 1985

[54] APPARATUS FOR TRANSPORTING CONTINUOUSLY ARRIVING FLAT PAPER PRODUCTS, ESPECIALLY A STREAM OF PRINTED PRODUCTS ARRIVING IN AN IMBRICATED FORMATION

[75] Inventors: Walter Reist; Jürg Eberle, both of Hinwil, Switzerland

[73] Assignee: Ferag AG, Hinwil, Switzerland

[21] Appl. No.: 496,899

[22] Filed: May 23, 1983

[30] Foreign Application Priority Data

Jun. 2, 1982 [CH] Switzerland ..... 3386/82

[51] Int. Cl.[3] ..... B65G 47/86

[52] U.S. Cl. ..... 198/479; 198/694; 271/205; 271/277

[58] Field of Search ..... 198/479, 650, 694, 696; 271/204, 205, 206, 277, 82, 188

[56] References Cited

U.S. PATENT DOCUMENTS 1,079,218 11/1913 Curtis ..... 271/204
1,920,715 8/1933 Sager ..... 271/204
3,955,667 5/1976 Muller et al. ..... 198/696
4,424,965 1/1984 Faltin ..... 271/204 X

FOREIGN PATENT DOCUMENTS 752322 7/1956 United Kingdom .

*Primary Examiner*—Joseph E. Valenza
*Assistant Examiner*—Jonathan D. Holmes
*Attorney, Agent, or Firm*—Werner W. Kleeman

[57] ABSTRACT

A guided endless, revolvingly driven traction element is equipped with controlled gripper units or grippers arranged in spaced relationship from each other. These gripper units are adapted to grip one margin of the paper products which constitutes a lateral marginal edge of the product as seen in the transport direction thereof. The gripper units have substantially planar clamping faces inclined at the same direction with respect to the traction element for stiffening that portion of the transported paper products which laterally project from the gripper units. The transported printed products thus have imparted thereto a corrugation or undulation extending transversely with respect to the transport direction which results in the desired stiffening of the products.

7 Claims, 4 Drawing Figures

APPARATUS FOR TRANSPORTING CONTINUOUSLY ARRIVING FLAT PAPER PRODUCTS, ESPECIALLY A STREAM OF PRINTED PRODUCTS ARRIVING IN AN IMBRICATED FORMATION

CROSS REFERENCE TO RELATED APPLICATION AND PATENTS

This application is related to the commonly assigned U.S. application Ser. No. 06/225,420, filed Jan. 15, 1981, now U.S. Pat. No. 4,381,056, granted Apr. 26, 1983. This application is also related to the commonly assigned U.S. Pat. No. 3,955,667, granted May 11, 1976 and the commonly assigned U.S. Pat. No. 4,201,286, granted May 6, 1980.

BACKGROUND OF THE INVENTION

The present invention relates to a new and improved construction of apparatus for transporting continuously arriving or inbound flat paper products, especially a stream of printed products arriving in an imbricated formation.

In its more particular aspects the apparatus for transporting continuously arriving flat paper products of the present development is of the type comprising a guided endless revolvingly driven traction element or means and controlled gripper units or grippers arranged at the traction element at a distance or in spaced relation from each other and adapted to grip one lateral margin or marginal edge of such paper products as seen in the transport or conveying direction thereof.

Apparatus of such general type is known in the art and one essential advantage thereof is that such apparatus does not need to be adapted to the size of the paper products to be transported provided that the lateral margins or marginal edges intended to be gripped of the consecutive paper products are to some extent in alignment with one another. The unilateral or one-sided, lateral gripping of the paper products, on the other hand, results in the same so-to-speak fluttering due to the air flow or travel wind, particularly at higher transport speeds of the products, and thus, causes them to become crumbled or creased. To prevent the undesired crumbling or creasing of the paper products in the known construction of apparatus stationary guiding rails are provided along the entire transport of conveying path for both of the flat sides of the paper products. If it is desired to change the course of the transport path in the state-of-the-art apparatus, it is required to also accommodate the guiding rails in the known apparatus to the new travel course. Significant in this regard is the transport system known as the "KS-Carrier" and described in the brochure of Kaneda Kikai Seisakusho, Ltd.

In a further transporting apparatus as known, for example, from British Pat. No. 752,322, published July 11, 1956, which also acts on one lateral margin or marginal edge of the paper products, it is intended to prevent the transported paper products from fluttering without providing guiding rails. The basic idea in this construction of prior art transporting apparatus is to practically eliminate the flexibility or bendability of the paper products to be transported about bending axes extending parallel relative to the direction of transport. For realizing this basic idea such transporting apparatus is not equipped with gripper units in the narrower sense of this term, but with two rows of disc-shaped entrainment elements arranged with parallel axes and coupled to an endless revolving traction element. The entrainment elements are covered, for example, by rubber at the circumference thereof. The entrainment elements are arranged in such a manner that the entrainment elements of one of the rows is positioned between two entrainment elements of the other rows and are resiliently biased towards the same. For charging this construction of transporting apparatus with paper products the two rows or series of entrainment elements are urged away from each other by appropriate control curves, the paper products are then introduced therebetween and then the entrainment elements are again released. As a consequence, a corrugated or undulatory shape extending transversely with respect to the direction of transport is imposed upon the paper products which results in the desired stiffening. However, since in this known design of transporting apparatus each entrainment element of one of the rows coacts with two entrainment elements of the other row, each of the imposed corrugation waves is fixedly clamped at the leading flank as well as at the trailing flank thereof, so that so-to-speak "breathing", i.e. stretching and/or compressing of the now corrugated shape of the transported paper products, is not readily possible. As a consequence thereof, small relative displacements or shifting movements occur between the entrainment elements, on the one hand, and the paper products, on the other hand, or between adjacent paper products in case the paper products arrive in a stream having an imbricated formation, in such known transporting apparatus when travelling through curves, either in the plane of or transversely with respect to the plane of the paper products. However, such relative displacements or shifting movements are detrimental for the paper products, since either the rubber-covered entrainment elements thus will "grind" or "erase" the paper products and/or there will occur friction between the products lying on top of each other.

SUMMARY OF THE INVENTION

Therefore, with the foregoing in mind it is a primary object of the present invention to provide a new and improved construction of apparatus for transporting continuously arriving flat paper products or the like, especially a stream of printed products arriving in an imbricated formation, which apparatus is not afflicted with the aforementioned drawbacks and limitations heretofore discussed.

Now in order to implement these and still further objects of the invention, which will become more readily apparent as the description proceeds, the apparatus of the present development is manifested by the features that, the gripper units or grippers possess substantially planar clamping surfaces or faces which are inclined in the same direction with respect to the traction element or means.

Since the substantially planar clamping surfaces or faces of the gripper units or grippers are inclined in the same direction with respect to the traction element or means they will also force or impose upon the paper products a corrugation or undulatory shape extending transversely with respect to the traction element or means. However, the gripper units or grippers only clamp either the trailing flank or rear or the leading flank or front of the corrugation waves, so that the front portion or, respectively, the rear portion thereof may be stretched or compressed, respectively, without there arising the aforementioned relative displacement or shifting movements.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
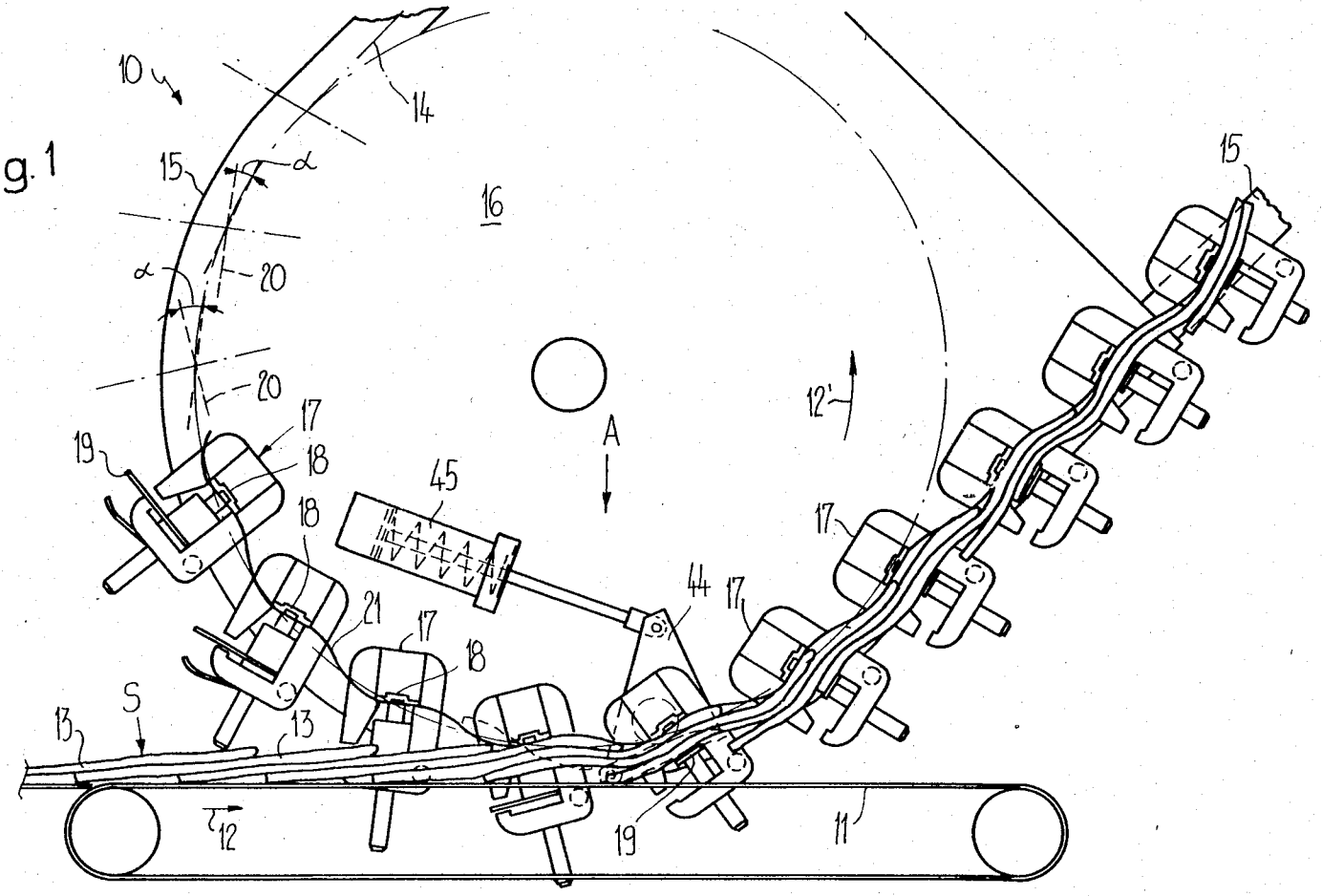
FIG. 1 is a schematic side view of a take-up station in a transport apparatus constructed according to the present invention.

Describing now the drawings, it is to be understood that only enough of the construction of the apparatus for transporting continuously arriving substantially flat paper products or the like has been shown as needed for those skilled in the art to readily understand the underlying principles and concepts of the present development, while simplifying the showing of the drawings. Turning attention now specifically to FIGS. 1 and 2, there has been schematically shown a conveyor belt or band 11 or equivalent structure travelling in a product conveying direction denoted by arrow 12. Printed products 13, which in this case are arranged in a product stream S in an imbricated product formation, are conveyed by the conveyor belt 11 towards an apparatus 10, of which in FIG. 1 there only are shown the take-over section for the transfer of the imbricated stream S containing the imbricated product formation and the starting section of the conveying run or strand.

This apparatus 10 comprises an endless rotatably driven traction element or means 14 appropriately driven so as to revolve in the direction of the arrow 12'. The traction element or means 14, as will be shown still later in this description, is guided in a hollow rail or rail member 15 and also around a guiding or deflection wheel or pulley 16 which is only schematically shown in FIG. 1. The traction element or means 14 is equipped with gripper units or grippers 17 which are spaced at regular intervals from one another and laterally attached thereto. Each of the gripper units or grippers 17 has a stationary first clamping or gripper jaw 18 which is fixed relative to the traction element or means 14 as well as a movable second clamping or gripper jaw 19. As will still be explained hereinafter the movable second jaw 19, in its opened position, is positioned essentially at right angles with respect to the stationary first jaw 18, however, during the course of the closing movement is firstly pivotable into a position below the stationary first jaw 18, then is displaceable towards the stationary first jaw 18 and finally, can be locked in a closing or closed position. Both of the aforedescribed pivoting and displacement movements occur against the action of a spring. As will be evident from FIG. 1, each of the stationary first clamping jaws 18 has a not particularly referenced clamping surface or face which substantially defines a plane. On the left-hand side of FIG. 1 this plane is shown by the dotted lines 20 for two adjacent stationary first clamping jaws 18 and it will be seen that each plane is inclined by an angle $\alpha$ with respect to the traction element or means 14. The planar clamping surface of each stationary clamping jaw 18 is arranged substantially parallel to a substantially planar clamping surface of the related movable clamping jaw 19. Moreover the planar clamping surfaces of the stationary clamping jaws 18 advantageously may possess a greater extension or dimension as measured in the direction of transport of the printed products than the clamping surfaces of the movable clamping jaws 19, as particularly evident from the showing of FIG. 4.

The stationary first clamping jaws 18 of all of the gripper units or grippers 17 are interconnected by a flexible band or tape 21 or equivalent structure which is suitably secured to the clamping surface or face of the related stationary first clamping jaw 18 of each gripper unit or gripper 17.

Figure 2:
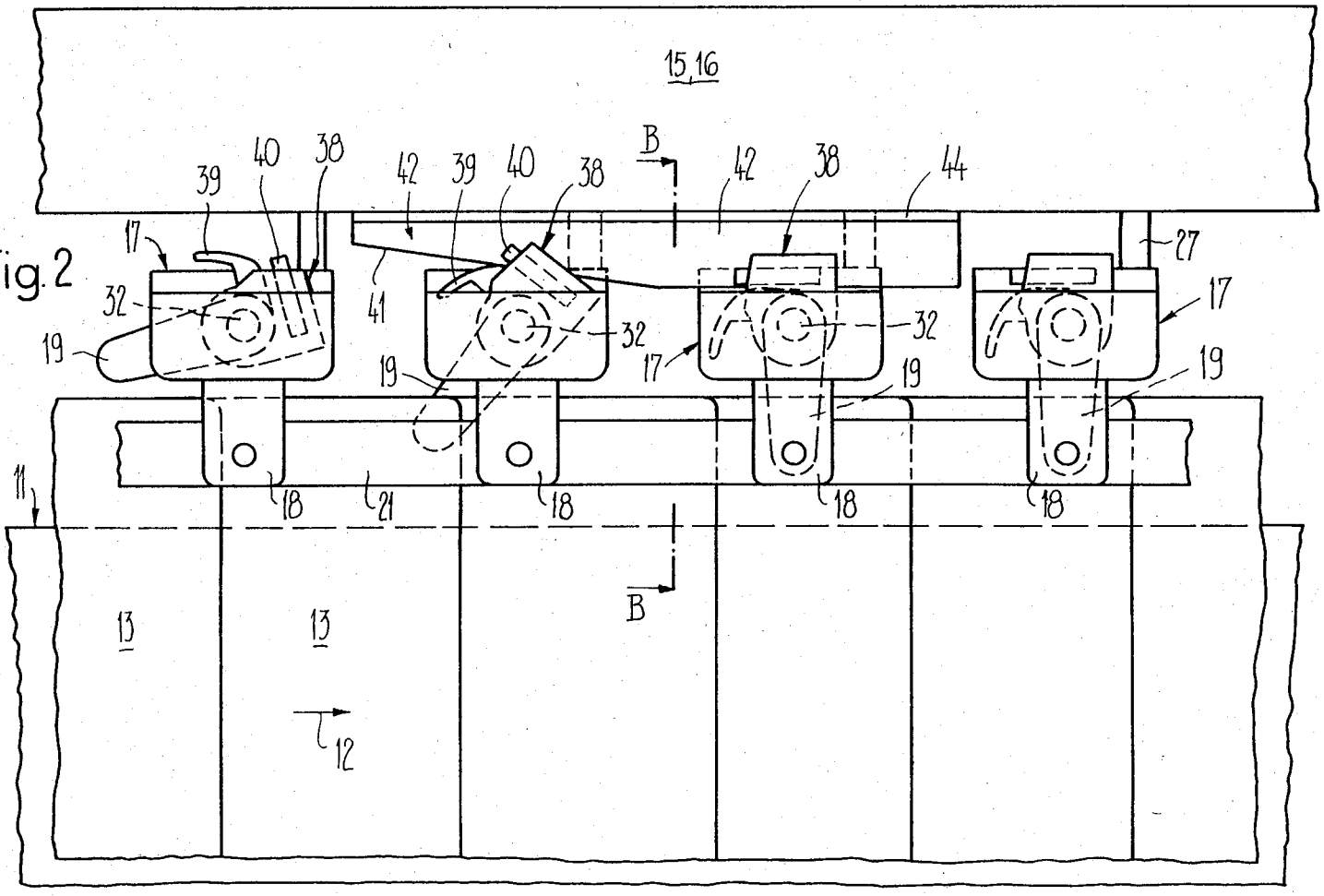
FIG. 2 is a top plan view on a somewhat enlarged scale of the apparatus shown in FIG. 1 as seen when looking in the direction of the arrow A of FIG. 1.

As a consequence of this arrangement, the product stream S arriving in an imbricated product formation upon the conveyor belt 11 and laterally protruding from the same, as shown in FIG. 2, is acted upon from above to a certain extent by a "corrugated or undulated conveyor band". During this action the movable second clamping jaws 19, after having been pivoted-in into a position beneath their related stationary clamping jaw 18 and after having been displaced towards the associated stationary first clamping jaw 18, press the product stream S of the imbricated product formation from below towards the "corrugated conveyor band", namely, in this particular embodiment in each case only against the rear or trailing flank of each corrugation or undulatory wave.

Figure 3:
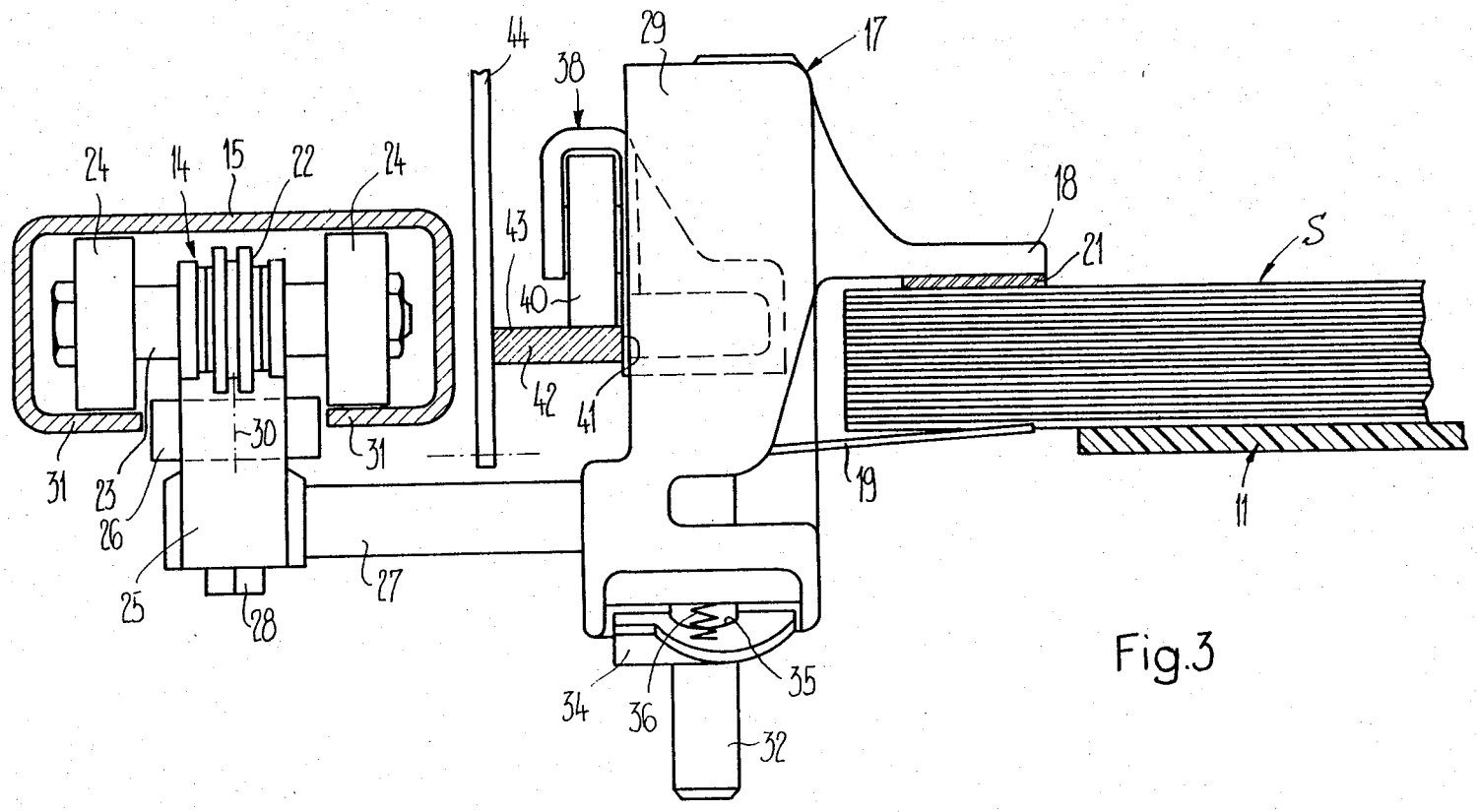
FIG. 3 is a sectional view, again on an enlarged scale, of the apparatus shown in FIG. 1 as seen when looking in the direction of the section line B—B of FIG. 2.

Reference is now additionally made to FIG. 3. The conveyor belt 11 supplying the product stream S in an imbricated product formation will be recognized as well as one of the gripper units or grippers 17 and the stationary first clamping jaw 18 thereof, the flexible band 21 affixed thereto and the movable second clamping jaw 19 thereof which is already located in its closed position. The hollow rail 15 is constituted by a substantially C-shaped profile which is open in the downward direction. The traction element or means 14 is received in the interior of this hollow rail 15. This traction element or means 14 comprises, for instance, a link chain 22 in which the link pin 23 or the like between two chain link members articulated to each other is prolonged to both sides and carries a bearing or travelling roller 24 at each of its opposed ends. A retaining or holder block 25 is mounted at each chain link member and extends out of the hollow rail 15. By means of a clamping bolt 28 or the like a laterally projecting cantilever or bracket 27 is clamped to the retaining or holder block 25 and the end of the cantilever or bracket 27 is anchored to a housing 29 of the related gripper unit or gripper 17. The retaining or holder block 25 partially covers a guiding roller 26 in FIG. 3 which is rotationally journaled at a shaft 30 which extends essentially at right angles to the link pin 23 and which shaft 30 has merely been schematically indicated by a dash-dotted line. Particularly in the case of a curved travel course of the hollow rail 15 this guiding or guide roller 26 cooperates with the confronting edges 31 of the hollow rail 15.

The structure of the gripper units or grippers 17 will be described hereinafter with reference to FIGS. 3 and 4. The stationary first clamping jaw 18 is formed integrally with the housing 29 thereof. The movable second clamping jaw 19, contrary thereto, is anchored to a rotatable stem or pin 32 via a clamping ring 37 so as to be non-rotatable with respect thereto. This stem or pin 32 or the like is substantially perpendicularly arranged with respect to the plane defined by the stationary first clamped jaw 18 and is rotatably journaled in the housing 29 so as to be longitudinally displaceable as well as rotatable against the force of a spring 33. This spring 33 tends to retain the movable second clamping jaw 19 in a position as shown on the left-hand side of FIG. 4.

Furthermore, a clamping lock or bar 34 is linked to the housing 29 and contains a bore 35, as shown in FIG. 3, through which the stem 32 piercingly extends. The clamping bar 34 is under the action of a pressure or compression spring 36, as also shown in FIG. 3, which tends to keep such clamping bar 34 in the downwardly pivoted position, i.e. pivoted in counterclockwise direction as seen in FIG. 4. Due to this arrangement the stem or pin 32 may be readily rotated and also readily upwardly displaced from the position shown at the left-hand side of FIG. 4, however, remains locked in the upwardly displaced or shifted position. In other words, the clamping bar or lock 34 acts in a way so as to provide a so-to-speak "free-run" for the longitudinal displacement of the stem 32 and which free-run may be released by lifting the clamping bar 34.

Figure 4:
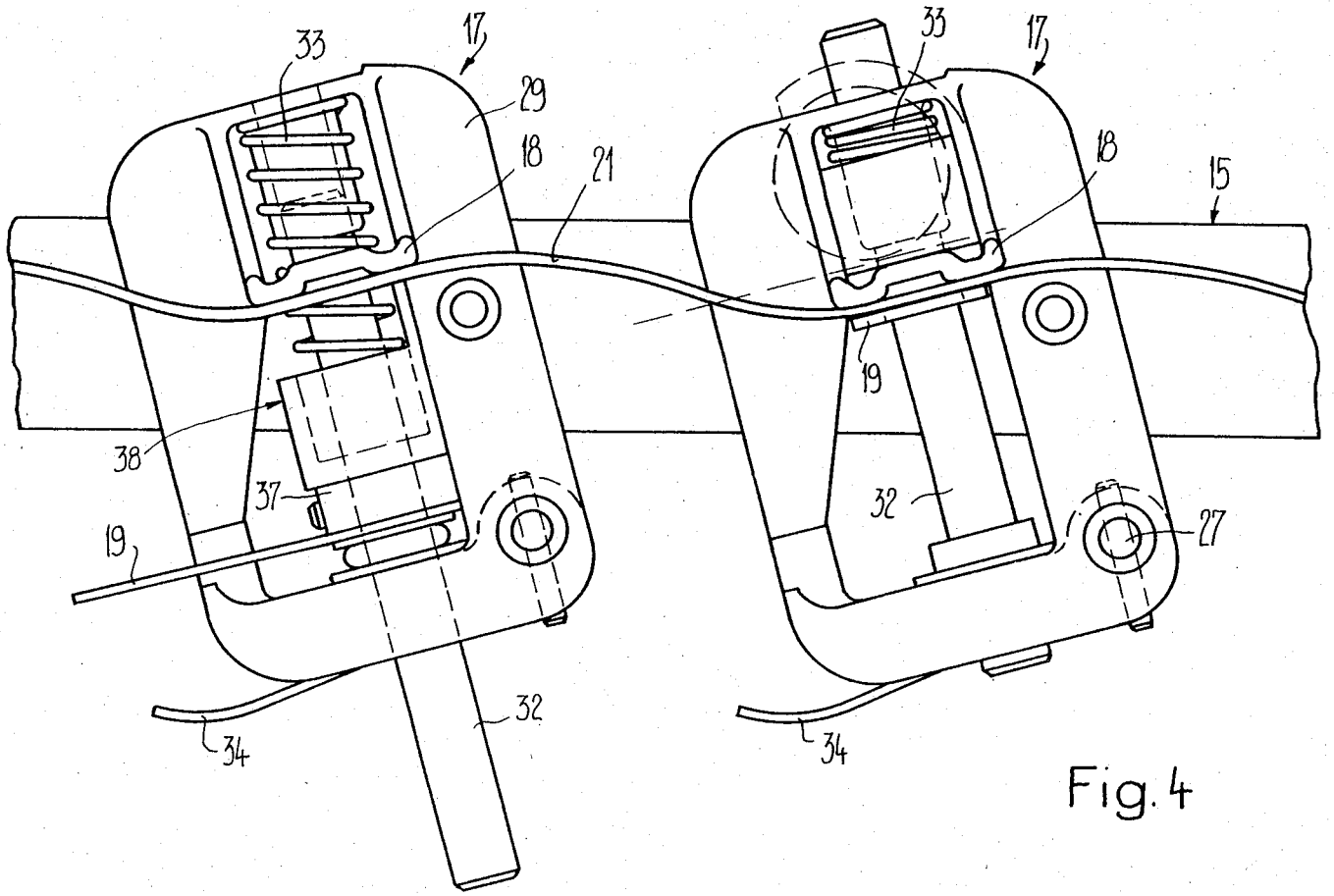
FIG. 4 is a side view, on an enlarged scale, of two consecutive or successive gripper units or grippers used in the apparatus shown in FIG. 1, the left-hand gripper being shown in its open position and the right-hand gripper being shown in its closed position.

It will be particularly evident from FIGS. 2, 3 and 4 that a further block 38 is anchored to the stem or pin 32 immediately above the clamping ring 37 serving to anchor the movable second jaw 19 at the stem 32. This block or block member 38 carries two follower members 39 and 40, one of which is a projection or nose member 39, as best seen from FIG. 2, while the other follower member comprises a roller 40 rotatably journaled at the block 38. It will be further evident from FIG. 2 that the projection or nose member 39 cooperates with a lateral edge or camming surface 41 of a control cam or curve 42 and causes the stem 32 to be rotated in counterclockwise direction, as seen in FIG. 2, against the action of the spring 33 when the projection or nose member 39 runs-up upon this lateral edge or camming surface 41. On the other hand, the roller 40 cooperates with the flat top side 43, as shown in FIG. 3, of the control cam 42 which, as indicated by dotted lines in FIG. 4, forms an ascending ramp. Thus, the stem 32 and conjointly therewith the movable second clamping jaw 19 are lifted, i.e. displaced towards the stationary first clamping jaw 18, following the rotational movement which is effected by the cooperation of the projection or nose member 39 with the lateral edge or camming surface 41. The movable second clamping jaw 19 remains locked in this position by the action of clamping bar 34. This movable second clamping jaw 19 thus clamps from below the imbricated product formation or stream S against the flexible band 21 which, due to the inclination of the clamping surfaces or faces of the stationary fixed clamping jaws 18, has a corrugated or undulatory shape.

The control cam or curve 42 is secured to a pivotable sheet metal bracket or metal plate 44 which may be pivoted from an operative to an inoperative position by any suitable actuating means like, for example, a pneumatic cylinder 45 or equivalent structure as shown in FIG. 1. Due to such actuation the control cam or curve 42 can be brought from its operative position, i.e. from a position in which the gripper units or grippers 17 are operated in closing direction, into an inoperative or rest position, i.e. into a position in which no paper products have to be taken-up or removed from the conveyor belt 11.

One or a number of delivery stations (not shown) of the apparatus may be positioned along the active conveying run or strand of the traction element or means 14 or may be arranged at the region of a further deflection or guide pulley upon which runs the active conveying run of the traction element 14. In addition to a device or means for receiving the conveyed printed products like, for example, a stacking chute or container or a conveyor belt, such delivery station only requires an element like, for example, a control cam or curve or a roller cooperating with the clamping bars 34 such that each clamping bar 34 is pivoted against the action of the pressure or compression spring 36, so that the movable second clamping jaw 19 can instantaneously jump or move back from the position shown at the right in FIG. 4 into the position shown at the left of such FIG. 4. The conveyed product stream S having an imbricated formation is thus released.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for transporting continuously arriving substantially flat paper products, especially a stream of printed products arriving in an imbricated formation, comprising:

a guided revolvingly driven endless traction means defining a predetermined direction of transport;

controlled gripper units arranged at said traction means in spaced relationship from each other;

each of said gripper units possessing a substantially planar clamping surface;

each of said planar clamping surfaces extending laterally of said traction means and at essentially the same predetermined inclination relative to said predetermined direction of transport of the paper products; and said gripper units serving to grip a lateral marginal edge of said paper products viewed in said predetermined direction of transport of the paper products and to thereby impart an undulatory configuration to the imbricated formation of said paper products.

2. The apparatus as defined in claim 1, wherein:

each said gripper unit comprises a clamping jaw stationarily arranged relative to said traction means;

said stationary clamping jaw possessing said substantially planar clamping surface; and each said gripper unit possessing a movable clamping jaw cooperating with said stationary clamping jaw.

3. The apparatus as defined in claim 2, further including: a flexible band interconnecting said stationary clamping jaws of said gripper units in order to hold down the undulatory configured imbricated formation.

4. The apparatus as defined in claim 2, wherein:

each said movable clamping jaw possessing a substantially planar clamping surface arranged substantially parallel to said clamping surface provided at said stationary clamping jaw.

5. The apparatus as defined in claim 4, wherein:

said planar clamping surfaces of said stationary clamping jaws have a greater extension as measured in said direction of transport than said clamping surfaces of said movable clamping jaws in a closed position thereof.

6. The apparatus as defined in claim 1, wherein:

said substantially planar clamping surfaces are rearwardly and downwardly inclined with respect to said direction of transport.

7. An apparatus for transporting substantially flat paper products arriving continuously and essentially in a plane, particularly for transporting a stream of printed products arriving in an imbricated formation, comprising:

a guided revolvingly driven endless traction means defining a conveying run running in a predetermined direction of transport of the paper products;

controlled gripper units mounted at said traction means in spaced relationship from each other;

each of said gripper units comprising a substantially planar clamping surface extending laterally from said traction means;

said planar clamping surfaces being inclined at essentially equal angles with respect to said plane in the direction of said conveying run; and said gripper unit serving to grip a lateral marginal region of said paper products and to impress thereupon an undulated configuration, the undulations of which extend substantially at right angles with respect to said conveying run of said endless traction means.

* * * * *